US008033151B2

(12) United States Patent
Castle et al.

(10) Patent No.: US 8,033,151 B2
(45) Date of Patent: Oct. 11, 2011

(54) METHOD AND APPARATUS FOR REDUCING FORCE NEEDED TO FORM A SHAPE FROM A SHEET METAL

(75) Inventors: James B. Castle, St. Charles, MO (US); Christopher S. Huskamp, St. Louis, MO (US); Kevin G. Waymack, Hazelwood, MO (US)

(73) Assignee: The Boeing Company, Chicago, IL (US)

( * ) Notice: Subject to any disclaimer, the term of this patent is extended or adjusted under 35 U.S.C. 154(b) by 302 days.

(21) Appl. No.: 12/420,399

(22) Filed: Apr. 8, 2009

(65) Prior Publication Data

US 2010/0257910 A1 Oct. 14, 2010

(51) Int. Cl.
*B21D 3/02* (2006.01)
*B21D 11/00* (2006.01)

(52) U.S. Cl. ..... 72/53; 72/75; 72/115; 72/429

(58) Field of Classification Search ..... 72/43, 53, 72/56, 75, 115, 429
See application file for complete search history.

(56) References Cited

U.S. PATENT DOCUMENTS 3,201,967 A * 8/1965 Balamuth et al. ..... 72/359
3,643,483 A * 2/1972 Minchenko et al. ..... 72/56
4,071,097 A 1/1978 Fulop et al.
4,129,027 A * 12/1978 Ignashev et al. ..... 72/429
4,828,052 A 5/1989 Duran et al.
5,419,791 A 5/1995 Folmer
5,771,729 A * 6/1998 Bailey et al. ..... 72/53
6,216,508 B1 * 4/2001 Matsubara et al. ..... 72/43
6,532,786 B1 3/2003 Luttgeharm
6,561,002 B2 * 5/2003 Okada et al. ..... 72/115
6,622,570 B1 * 9/2003 Prevey, III ..... 72/75
6,748,780 B1 * 6/2004 Luttgeharm ..... 72/115
6,971,256 B2 12/2005 Okada et al.
2006/0272378 A1 * 12/2006 Amino et al. ..... 72/305

OTHER PUBLICATIONS

Lamminen et al., "Incremental Sheet Forming with an Industrial Robot", Materials Forum vol. 29, 2005, Institute of Materials Engineering Australasia Ltd, pp. 331-335.
Pohlak et al., "Manufacturability and limitations in incremental sheet forming", Proc. Estonian Acad. Sci. Engl, 2007, pp. 129-139.
U.S. Appl. No. 12/062,994, filed Apr. 4, 2008, Huskamp et al.
U.S. Appl. No. 12/486,968, filed Jun. 18, 2009, Huskamp et al.
U.S. Appl. No. 12/486,960, filed Jun. 18, 2009, Young et al.
U.S. Appl. No. 12/420,433, filed Apr. 8, 2009, Huskamp et al.

* cited by examiner

*Primary Examiner* — David Jones
(74) *Attorney, Agent, or Firm* — Yee & Associates, P.C.

(57) ABSTRACT

An apparatus comprising a platform, a stylus, and an ultrasonic energy generation system. The platform may be capable of holding a sheet of material. The stylus may be capable of impinging the sheet of material to incrementally form a shape for a part. The ultrasonic energy generation system may be capable of sending ultrasonic energy into at least a portion of the sheet of material in a location on the sheet of material where the stylus impinges the sheet of material.

19 Claims, 5 Drawing Sheets

METHOD AND APPARATUS FOR REDUCING FORCE NEEDED TO FORM A SHAPE FROM A SHEET METAL

CROSS-REFERENCE TO RELATED APPLICATION

The present disclosure is related to the United States patent application entitled "Method and Apparatus for Reducing Force Needed to Form a Shape from a Sheet Metal", application Ser. No. 12/420,433, filed even date hereof, assigned to the same assignee, and incorporated herein by reference.

BACKGROUND INFORMATION

1. Field

The present disclosure relates generally to manufacturing and, in particular, to manufacturing parts. Still more particularly, the present disclosure relates to incremental sheet forming using ultrasonic energy.

2. Background

Oftentimes, aircraft parts may be manufactured in limited runs or numbers. For example, one or two parts may be created as a prototype for testing. As another example, a small number of parts may be manufactured for an aircraft that is no longer in commercial production. With these types of parts, incremental sheet metal forming may be used to manufacture aircraft parts. Incremental sheet metal forming may be used to manufacture parts more cheaply and/or quickly than other techniques.

For example, without limitation, with incremental sheet metal forming, a part may be manufactured in a manner to reduce tooling costs. Further, incremental sheet metal forming may be useful when parts are needed only in limited numbers and/or for prototype testing.

In manufacturing parts, incremental sheet metal forming may be used to create a shape for a part from a sheet of material. Incremental sheet metal forming may be used with sheet metal to form a part. For example, sheet metal may be formed using a round-tipped tool, stylus, and/or some other suitable type of tool. This tool may be attached to a computer numerical control machine, a robot arm, and/or some other suitable system to shape the sheet metal into the desired shape for the part. The tool may make indentations, creases, and/or other physical changes or deformations into the sheet metal that may follow a contour for the desired part. This contour may be defined using a tool on which the stylus presses the sheet metal material.

Further, incremental sheet metal forming may be used to produce complex shapes from various materials. This type of process may provide easy part modification. For example, a part may be modified by changing the model of the part without requiring retooling or new dies.

Incremental sheet metal forming may be performed on a number of different types of sheet metal materials. For example, without limitation, incremental sheet metal forming may be performed using aluminum, steel, titanium, and/or other suitable metals.

With some sheet metal materials, the amount of force needed to shape a sheet metal may result in forces that may damage the sheet metal forming machine. With this situation, other types of techniques may be used to form the part. For example, without limitation, the parts may be stamped out of the sheet metal material using a press with dies. As another alternative, a commercially available incremental sheet metal forming machine may be modified and/or designed to accommodate the higher forces needed for thicker sheet metal materials and/or metals that may have a higher material yield strength. With materials possessing a higher material yield strength, the amount of force needed to shape the material may increase.

Modifying an incremental sheet metal forming machine or purchasing an incremental sheet metal forming machine to lower the forming forces may increase the cost for manufacturing parts. This type of solution, however, may be desirable over using other types of forming processes such as, for example, without limitation, stamping the sheet metal using dies. Even though the costs may be higher, the time needed to adjust designs may be reduced.

Thus, it would be advantageous to have a method and apparatus that takes into account at least some of the issues discussed above, as well as possibly other issues.

SUMMARY

In one advantageous embodiment, an apparatus may comprise a platform, a stylus, and an ultrasonic energy generation system. The platform may be capable of holding a sheet of material. The stylus may be capable of impinging the sheet of material to incrementally form a shape for a part. The ultrasonic energy generation system may be capable of sending ultrasonic energy into at least a portion of the sheet of material in a location on the sheet of material prior to the stylus impinging the location.

In another advantageous embodiment, an incremental sheet metal forming machine may comprise a platform, a stylus, a motion control system, an ultrasonic energy generation system, a number of sensors, a thermal control system, and a control system. The platform may be capable of holding a sheet of material. The stylus may be capable of impinging the sheet of material to incrementally form a shape for a part. The motion control may be a system capable of controlling movement of the stylus. The ultrasonic energy generation system may comprise a number of ultrasonic energy generation devices. The ultrasonic energy generation system may be capable of causing vibrations in a at least portion of the sheet of material in a location on the sheet of material in an area around the stylus prior to the stylus impinging the location to cause at least one of a temporary reduction in yield strength, a temporary increase in elongation, a temporary increase in ductility, and a temporary reduction in a modulus for the sheet of material. The ultrasonic energy generation system may be coupled to the stylus. The number of ultrasonic energy generation devices may be selected from at least one of a transducer and an ultrasonic actuator. The number of sensors may be capable of generating information. The number of sensors may be selected from at least one of a temperature sensor, a vibration sensor, a microphone, and a load sensor. The thermal control system may be capable of controlling ultrasonic energy generated by the ultrasonic energy generation system using the information generated by the number of sensors. The control system may be capable of controlling the ultrasonic energy generated by the ultrasonic energy generation system using the information from the number of sensors.

In yet another advantageous embodiment, a method may be present for processing a sheet of material. The sheet of material may be secured relative to a tool in an incremental sheet metal forming machine. The sheet of material may be incrementally shaped into a shape of a part using a stylus. Ultrasonic energy may be sent into at least a portion of the sheet of material in a location at which the stylus is to impinge prior to the stylus impinging the sheet of material at the location.

In still another advantageous embodiment, a method may be present for processing a sheet of metal material into a shape for an aircraft part. The sheet of metal material may be secured relative to a tool in an incremental sheet metal forming machine. The sheet of metal material may be incrementally shaped into the shape of the aircraft part using a stylus. Ultrasonic energy may be sent into at least a portion of the sheet of metal material in a location at which the stylus is to impinge prior to the stylus impinging the sheet of metal material at the location to cause vibrations in the portion of the sheet of metal material that causes at least one of a temporary reduction in yield strength, a temporary increase in elongation, a temporary increase in ductility, and a temporary reduction in a modulus for the sheet of metal material.

The features, functions, and advantages can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the advantageous embodiments are set forth in the appended claims. The advantageous embodiments, however, as well as a preferred mode of use, further objectives, and advantages thereof, will best be understood by reference to the following detailed description of an advantageous embodiment of the present disclosure when read in conjunction with the accompanying drawings, wherein:

DETAILED DESCRIPTION

Figure 1:
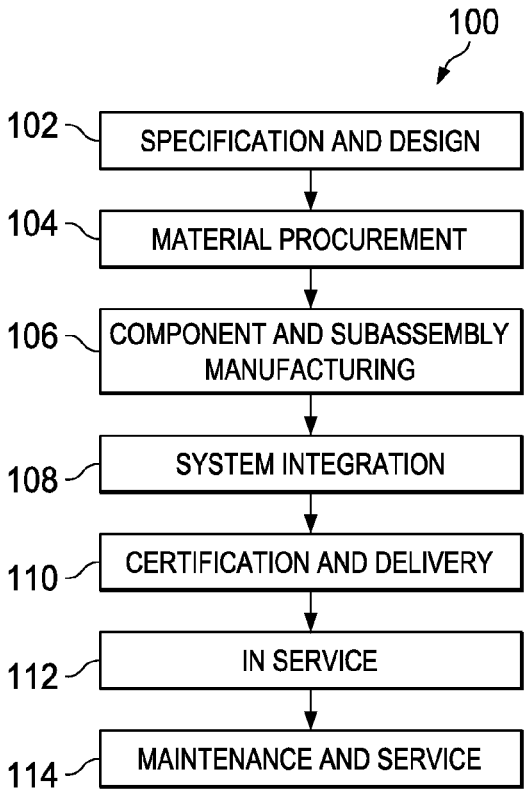
FIG. 1 is an illustration of an aircraft manufacturing and service method in accordance with an advantageous embodiment.
Figure 2:
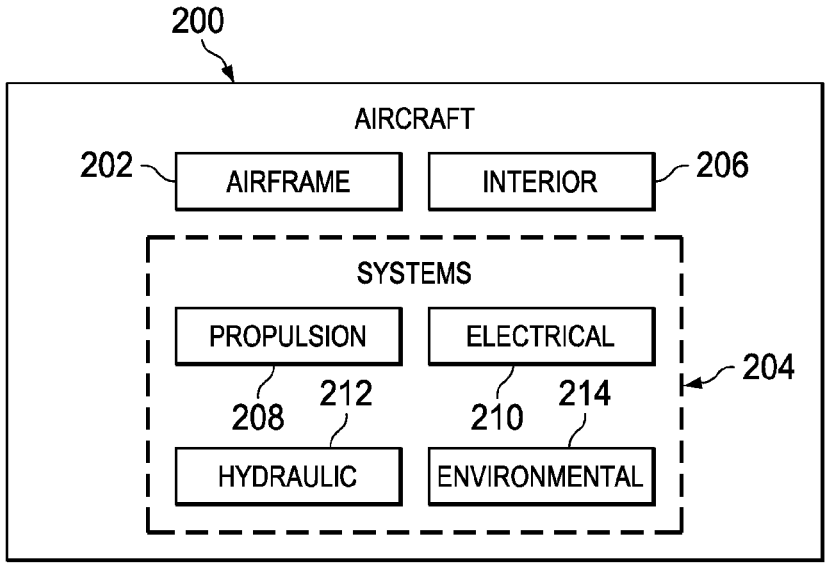
FIG. 2 is an illustration of an aircraft in which an advantageous embodiment may be implemented.

Referring more particularly to the drawings, embodiments of the disclosure may be described in the context of aircraft manufacturing and service method 100 as shown in FIG. 1 and aircraft 200 as shown in FIG. 2. Turning first to FIG. 1, an illustration of an aircraft manufacturing and service method is depicted in accordance with an advantageous embodiment. During pre-production, exemplary aircraft manufacturing and service method 100 may include specification and design 102 of aircraft 200 in FIG. 2 and material procurement 104.

During production, component and subassembly manufacturing 106 and system integration 108 of aircraft 200 in FIG. 2 takes place. Thereafter, aircraft 200 in FIG. 2 may go through certification and delivery 110 in order to be placed in service 112. While in service by a customer, aircraft 200 in FIG. 2 is scheduled for routine maintenance and service 114, which may include modification, reconfiguration, refurbishment, and other maintenance or service.

Each of the processes of aircraft manufacturing and service method 100 may be performed or carried out by a system integrator, a third party, and/or an operator. In these examples, the operator may be a customer. For the purposes of this description, a system integrator may include, without limitation, any number of aircraft manufacturers and major-system subcontractors; a third party may include, without limitation, any number of venders, subcontractors, and suppliers; and an operator may be an airline, leasing company, military entity, service organization, and so on.

With reference now to FIG. 2, an illustration of an aircraft is depicted in which an advantageous embodiment may be implemented. In this example, aircraft 200 is produced by aircraft manufacturing and service method 100 in FIG. 1 and may include airframe 202 with a plurality of systems 204 and interior 206. Examples of systems 204 include one or more of propulsion system 208, electrical system 210, hydraulic system 212, and environmental system 214. Any number of other systems may be included. Although an aerospace example is shown, different advantageous embodiments may be applied to other industries, such as the automotive industry.

Apparatus and methods embodied herein may be employed during any one or more of the stages of aircraft manufacturing and service method 100 in FIG. 1. For example, components or subassemblies produced in component and subassembly manufacturing 106 in FIG. 1 may be fabricated or manufactured in a manner similar to components or subassemblies produced while aircraft 200 is in service 112 in FIG. 1.

Also, one or more apparatus embodiments, method embodiments, or a combination thereof may be utilized during production stages, such as component and subassembly manufacturing 106 and system integration 108 in FIG. 1, for example, without limitation, by substantially expediting the assembly of or reducing the cost of aircraft 200. Similarly, one or more of apparatus embodiments, method embodiments, or a combination thereof may be utilized while aircraft 200 is in service 112 or during maintenance and service 114 in FIG. 1.

As another example, one or more of the different advantageous embodiments may be used to manufacture parts for use in aircraft 200 during component and subassembly manufacturing 106 and/or maintenance and service 114.

The different advantageous embodiments recognize and take into account a number of considerations. For example, the different advantageous embodiments recognize and take into account that with the performance of this type of incremental sheet metal forming in room temperature conditions, the forces required to shape the material into the desired geometry may be higher than other materials with lower yield strength.

The different advantageous embodiments recognize and take into account that with some materials, the force generated may be high enough to cause damage to commercially available incremental sheet forming equipment, robotic equipment, computer numerical control machining equipment, and/or other types of automated equipment. The different advantageous embodiments recognize and take into account that the bending loads coupled with the constant motion and change of direction may also exceed the capacity of smaller diameter styluses. In other words, the tool may break or malfunction.

The different advantageous embodiments also recognize and take into account that when forces are high enough to bend, plastically deform, and/or modify materials into the desired shape, these materials may break.

Further, the different advantageous embodiments also recognize and take into account that the stylus needed to impinge or press on the metal material may increase in diameter to support the force needed to bend the material. This increase in diameter of the stylus may reduce the amount of detail and/or accuracy desired for the shape of the part.

Thus, the different advantageous embodiments provide a method and apparatus for manufacturing parts with desired geometries on materials having desired yield strengths.

The advantageous embodiments may provide a method and apparatus for incrementally shaping a sheet of material into a shape for a part. In one advantageous embodiment, an apparatus comprises a platform capable of holding a sheet of material, a stylus capable of impinging this sheet of material to incrementally form the shape for the part, and an ultrasonic energy generation system capable of sending ultrasonic energy into a portion of the sheet of material in a location on the sheet of material in which the location may be one on which the stylus impinges.

Figure 3:
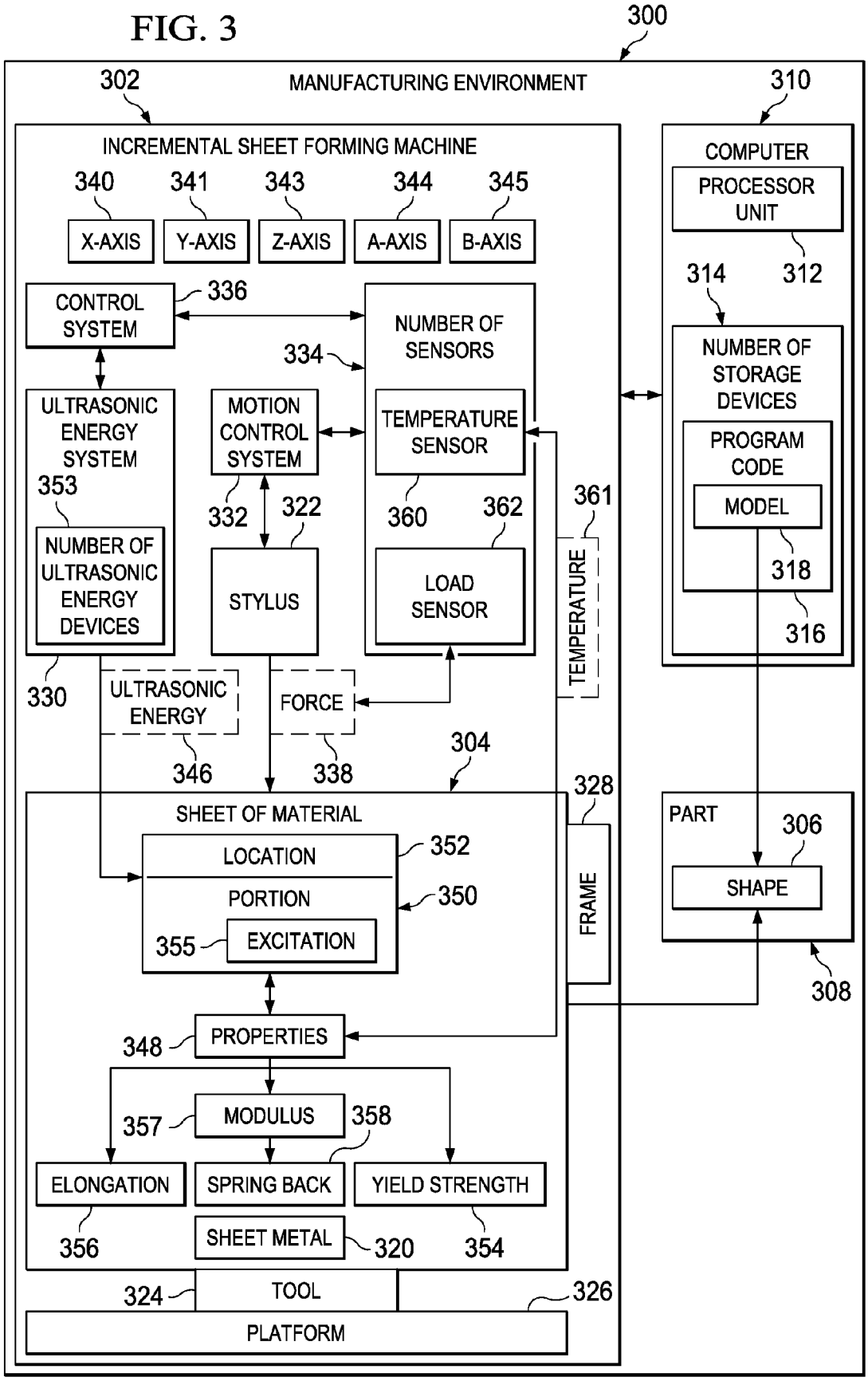
FIG. 3 is an illustration of a manufacturing environment in accordance with an advantageous embodiment.

Turning now to FIG. 3, an illustration of a manufacturing environment is depicted in accordance with an advantageous embodiment. Manufacturing environment 300 may be used to manufacture parts for aircraft 200 in FIG. 2 in these illustrative examples.

Incremental sheet forming machine 302 may incrementally process sheet of material 304 into shape 306 for part 308. Part 308 may be used in aircraft 200 in FIG. 2 in these illustrative examples. Incremental sheet forming machine 302 may incrementally change shape 306 of sheet of material 304. In other words, shape 306 may be formed in multiple steps, rather than in a single step, in these illustrative examples.

This processing of sheet of material 304 may be controlled by computer 310. Computer 310 may have processor unit 312 and number of storage devices 314. Program code 316 may be located on number of storage devices 314. A number, as used herein, when referring to items, means one or more items. For example, number of storage devices 314 is one or more storage devices.

Program code 316 may be located on number of storage devices 314. Number of storage devices 314 may be any storage device capable of storing program code 316 in a functional form for execution by processor unit 312.

Processor unit 312 may be, for example, without limitation, a central processing unit, a multi-core processor, multiple processors, and/or some other suitable processing device or system. Number of storage devices 314 may take various forms. For example, without limitation, number of storage devices 314 may include a random access memory, a read-only memory, a hard disk drive, a solid state disk drive, and/or some other suitable type of storage device.

In these illustrative examples, program code 316 may be executed by processor unit 312 to control incremental sheet forming machine 302 to generate shape 306 for part 308 from sheet of material 304. Shape 306 may be defined using model 318 in these illustrative examples. Model 318 may be a computer-aided design model for part 308.

In these illustrative examples, sheet of material 304 may take various forms. For example, without limitation, sheet of material 304 may take the form of sheet metal 320. Sheet metal 320 may be made from various types of metals. For example, without limitation, sheet metal 320 may be comprised of aluminum, titanium, steel, magnesium, a steel alloy, a nickel alloy, an aluminum alloy, a titanium alloy, and/or any other suitable type of metal. Of course, in other advantageous embodiments, sheet of material 304 may be comprised of other types of materials such as, for example, without limitation, non-metal materials, thermoplastic materials, and/or other suitable types of materials.

Incremental sheet forming machine 302, in these illustrative examples, may include stylus 322, tool 324, platform 326, frame 328, ultrasonic energy system 330, motion control system 332, number of sensors 334, control system 336, and/or any other suitable component.

Stylus 322 may impinge on sheet of material 304 to apply force 338 on sheet of material 304 to create shape 306 from sheet of material 304 to form part 308. In these examples, shape 306 may be incrementally created. In other words, shape 306 may not be formed in a single motion as in die stamping and/or break press machines. Shape 306 may be formed in numerous steps through stylus 322 impinging on sheet of material 304. Tool 324 may be placed on and/or secured to platform 326. Tool 324 may provide an initial shape or place for the shape to be formed. Sheet of material 304 may be held in place on platform 326 using frame 328.

Further, motion control system 332 may move stylus 322 relative to these different components to create shape 306 in sheet of material 304. In the different advantageous embodiments, frame 328 also may move relative to stylus 322. For example, without limitation, frame 328 may move along X-axis 340 and Y-axis 341, while stylus 322 moves along Z-axis 343. In other advantageous embodiments, platform 326 may move along Z-axis 343. Stylus 322 also may be positioned about A-axis 344 and B-axis 345. In these examples, A-axis 344 may be rotated about X-axis 340, and B-axis 345 may be rotated about Y-axis 341. Of course, other numbers of axes may be used, depending on the particular implementation.

Ultrasonic energy system 330 may be capable of generating ultrasonic energy 346 that is sent into portion 350 of sheet of material 304 in location 352 prior to and/or while stylus 322 may be impinging on location 352. In these illustrative examples, portion 350 of sheet of material 304 may be an area around stylus 322 upon impingement of location 352 on sheet of material 304 by stylus 322.

Ultrasonic energy 346 may be energy having a cyclic sound pressure. Ultrasonic energy 346 may have any frequency capable of penetrating sheet of material 304 in these illustrative examples. Ultrasonic energy 346 may be a frequency greater than around 20 kilohertz. Of course, other frequencies may be used that are capable of penetrating and/or being introduced into sheet of material 304 in these examples. Ultrasonic energy 346 may cause vibrations and/or energy waves within sheet of material 304.

In these different illustrative examples, ultrasonic energy system 330 may be number of ultrasonic energy devices 353. Number of ultrasonic energy devices 353 may be selected from at least one of a transducer, an ultrasonic actuator, and/or some other suitable type of ultrasonic generating device. As used herein, the phrase "at least one of", when used with a list of items, means that different combinations of one or more of the listed items may be used and only one of each item in the list may be needed. For example, "at least one of item A, item B, and item C" may include, for example, without limitation, item A; or item A and item B. This example also may include item A, item B, and item C; or item B and item C.

Number of ultrasonic energy devices 353 may be capable of sending ultrasonic energy 346 into portion 350 of sheet of material 304 in location 352 in a manner that may cause excitation 355 in portion 350 of sheet of material 304 in the manner that changes properties 348 of sheet of material 304 at portion 350.

Number of ultrasonic energy devices 353 may send ultrasonic energy 346 directly into portion 350 and/or through stylus 322 into portion 350. Ultrasonic energy 346 may be sent before and/or while stylus 322 impinges location 352. Properties 348 may be changed such that yield strength 354 for sheet of material 304 decreases such that sheet of material 304 may be more easily formed into shape 306 as compared to processing sheet of material 304 without introducing ultrasonic energy 346 into sheet of material 304.

Further, properties 348 also may be changed such that modulus 357 decreases for sheet of material 304 and elongation 356 increases for sheet of material 304. The reduction in modulus 357 may cause a reduction in spring back 358 for a given load and geometry of sheet of material 304. Changes in properties 348 also may include other characteristics of sheet of material 304 in these illustrative examples. In these illustrative examples, changes to properties 348 of sheet of material 304 may be temporary changes. In other words, when ultrasonic energy 346 is no longer applied to sheet of material 304, properties 348 may return to the same and/or substantially the same properties as prior to heating.

In these illustrative examples, number of sensors 334 may include vibration sensor 360, which may provide information about properties 348, such as excitation 361, to control system 336. Excitation 361 may be an elevation in the energy level or electron configuration of sheet of material 304. Excitation 361 may change as a result of the introduction of ultrasonic energy 346 into portion 350 of sheet of material 304. Vibration sensor 360 may be used by control system 336 to detect excitation 361 to control the amount of ultrasonic energy generated by number of ultrasonic energy devices 353. This control of number of ultrasonic energy devices 353 may be provided through control system 336.

Control system 336 may control the application of ultrasonic energy 346 to sheet of material 304 in a manner that avoids increasing properties 348 in an undesired manner. For example, without limitation, control system 336 may control properties 348 to avoid overexciting sensitive materials within sheet of material 304 in response to the introduction of ultrasonic energy 346 into sheet of material 304. Control system 336 may be, for example, without limitation, a computer similar to computer 310, an application specific integrated circuit (ASIC), a process executed by computer 310, and/or some other suitable control mechanism.

In this manner, number of ultrasonic energy devices 353 may be controlled by control system 336 to prevent excitation 361 from reaching a value that may be undesirable in response to the application of ultrasonic energy 346.

With incremental sheet forming machine 302, a capability may be provided to introduce ultrasonic energy 346 into materials in a manner that may reduce force 338 that may be needed to incrementally shape sheet of material 304 into shape 306 for part 308.

The illustration of manufacturing environment 300 in FIG. 3 is not meant to imply physical or architectural limitations to the manner in which different advantageous embodiments may be implemented. Other components in addition to and/or in place of the ones illustrated may be used. Some components may be unnecessary in some advantageous embodiments. Also, the blocks are presented to illustrate some functional components. One or more of these blocks may be combined and/or divided into different blocks when implemented in different advantageous embodiments.

For example, in some advantageous embodiments, manufacturing environment 300 may include an additional incremental sheet forming machine in addition to incremental sheet forming machine 302 in FIG. 3. In yet other advantageous embodiments, an additional stylus, in addition to stylus 322, may be controlled and moved to generate shape 306 for part 308. As another example, in some advantageous embodiments, a motion control system may be a separate component from incremental sheet forming machine 302.

In yet other advantageous embodiments, vibration sensor 360 may be unnecessary with control system 336. Number of sensors 334 may include, for example, without limitation, a temperature sensor, a microphone, and/or some other suitable sensor. In yet other advantageous embodiments, force 338 may be identified by load sensor 362 with control system 336 controlling ultrasonic energy 346 generated by number of ultrasonic energy devices 353 based on load on various components within incremental sheet forming machine 302.

Although excitation 361 is monitored in these illustrative examples, heat is not necessarily the mechanism that provides for an increased capability to generate shape 306. The application of ultrasonic energy 346 induces excitation 355 in a manner that may allow for easier shaping of sheet metal 320 into shape 306 for part 308. Further, for a given load, the application of ultrasonic energy 346 may also increase the speed of forming when soft materials are used for sheet of material 304.

Figure 4:
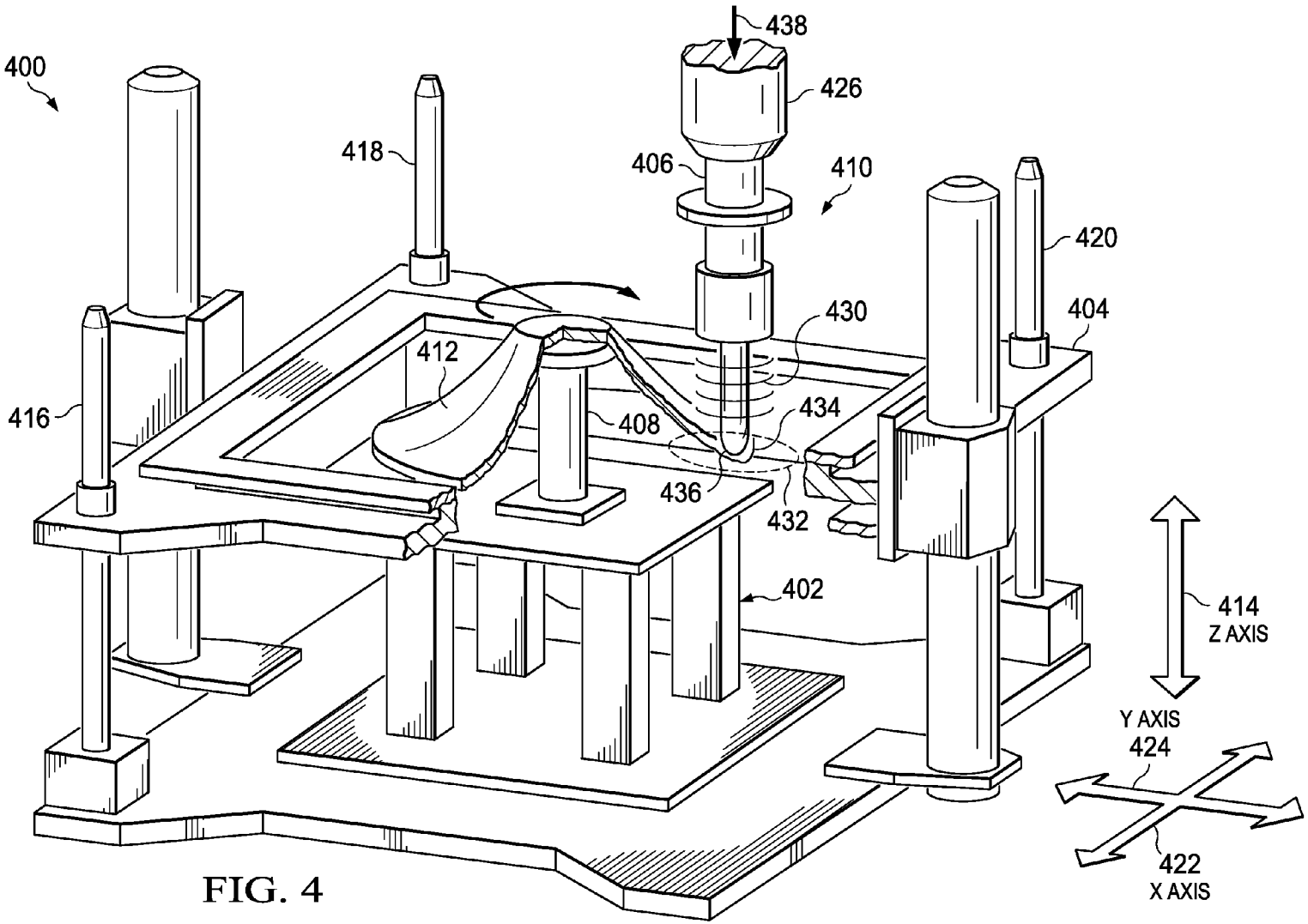
FIG. 4 is an illustration of an incremental sheet forming machine in accordance with an advantageous embodiment.

With reference now to FIG. 4, an illustration of an incremental sheet forming machine is depicted in accordance with an advantageous embodiment. In this illustrative example, incremental sheet forming machine 400 is an example of one implementation for incremental sheet forming machine 302 in FIG. 3.

In this illustrative example, incremental sheet forming machine 400 may include platform 402, frame 404, stylus 406, forming tool 408, and ultrasonic energy system 410.

Sheet metal material 412 may be secured to frame 404. Frame 404, in these examples, may take the form of a clamp plate that may be moveable along Z-axis 414. Frame 404 may move along Z-axis 414 along guideposts 416, 418, and 420. Another guidepost may be present but is not shown in this partial cutaway view. Platform 402 may be moveable along X-axis 422 and Y-axis 424 in these illustrative examples. In other advantageous embodiments, frame 404 may be stationary, while platform 402 may be moveable along Z-axis 414.

As depicted, forming tool 408 may be secured to and/or attached to platform 402 in these illustrative examples. In this manner, movement of platform 402 may also cause movement of forming tool 408. Further, forming tool 408 may move along Z-axis 414, while platform 402 may move along X-axis 422 and Y-axis 424. Stylus 406 may move downward to create a shape for sheet metal material 412. Further, in these illustrative examples, frame 404 also may move downward during the forming of the shape for sheet metal material 412.

Stylus 406 in frame 404 may move downward in small increments. The increment may be, for example, without limitation, from around 0.001 inches to around 0.015 inches. With each downward increment, platform 402 may move along X-axis 422 and Y-axis 424 to provide features for the shape of sheet metal material 412. This incremental movement may continue until the shape of the part is formed.

In this illustrative example, ultrasonic energy system 410 may include ultrasonic energy device 426. Ultrasonic energy device 426 may generate ultrasonic energy 430, which may enter portion 432 in location 434 of sheet metal material 412. Portion 432 may be around tip 436 of stylus 406. By introducing ultrasonic energy 430 into portion 432, stylus 406 may apply force 438 in a manner that allows sheet metal material 412 to plastically deform more easily at location 434 as compared to not sending ultrasonic energy 430 to sheet metal material 412.

In this illustrative example, only ultrasonic energy device 426 is illustrated. Of course, in other advantageous embodiments, other numbers and configurations of ultrasonic energy devices may be used. The number and/or arrangement of ultrasonic energy devices may be such that portion 432 is exposed to ultrasonic energy 430 prior to stylus 406 impinging any part of portion 432. For example, an ultrasonic energy device may be attached to a robotic arm and may be positioned by the robotic arm to introduce ultrasonic energy 430 into portion 432.

This introduction of ultrasonic energy 430 into portion 432 may change the characteristics of sheet metal material 412 to cause at least one of a temporary reduction in yield strength, a temporary increase in elongation, a temporary increase in ductility, a temporary reduction in the modulus of sheet metal material 412, and/or some other desirable change for sheet metal material 412.

Figure 5:
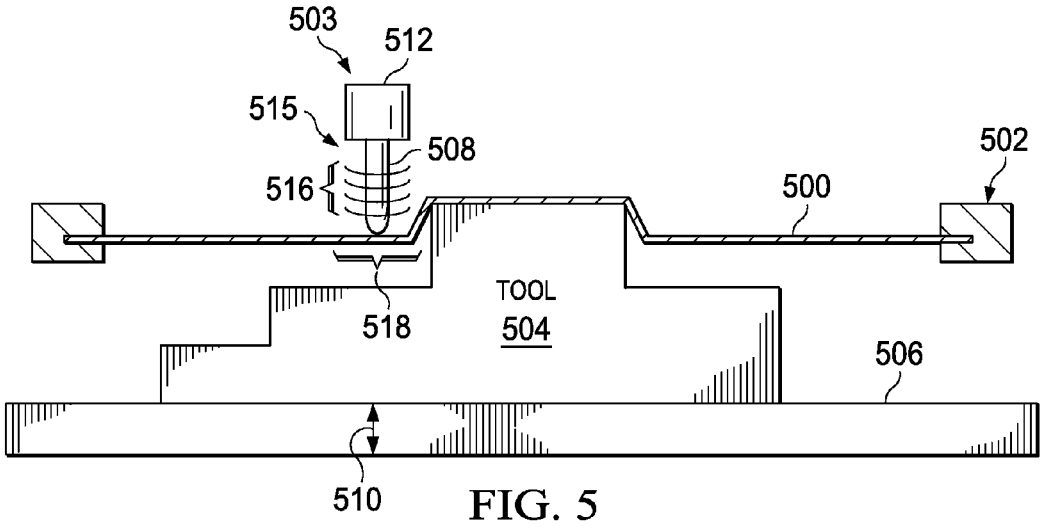
FIG. 5 is an illustration of incremental sheet metal forming in accordance with an advantageous embodiment.
Figure 6:
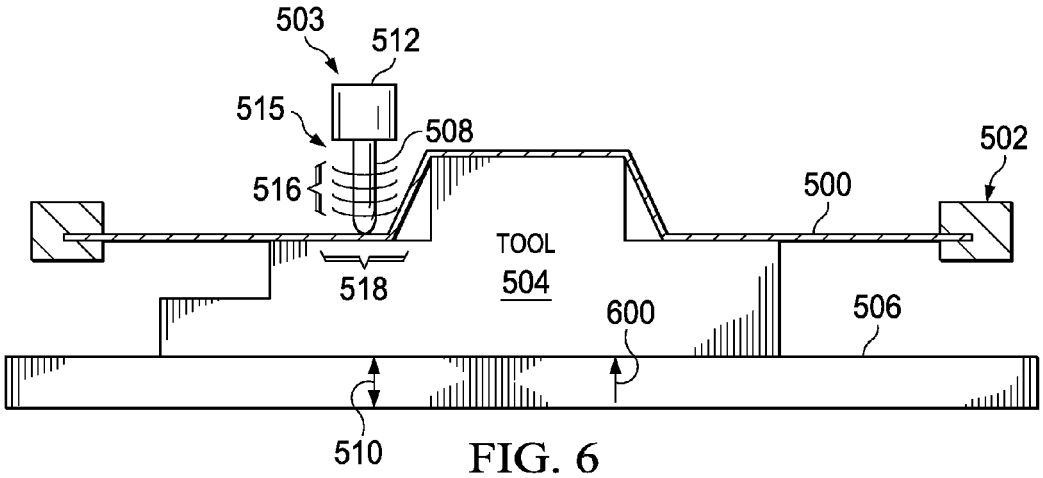
FIG. 6 is an illustration of incremental sheet metal forming in accordance with an advantageous embodiment.
Figure 7:
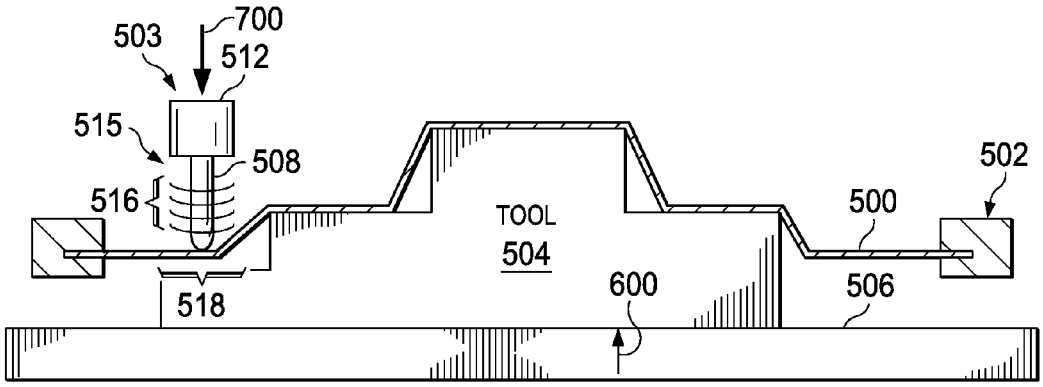
FIG. 7 is an illustration of incremental sheet metal forming in accordance with an advantageous embodiment.

With reference next to FIGS. 5, 6, and 7, illustrations of incremental sheet metal forming are depicted in accordance with an advantageous embodiment. In FIG. 5, sheet metal material 500 may be held in frame 502 in incremental sheet forming machine 503. Tool 504 may sit on platform 506. Stylus 508 may move along Z-axis 510 to shape sheet metal material 500. Stylus 508 may move downward, while platform 506 may move upward.

During this and any impingement of stylus 508 on sheet metal material 500, ultrasonic energy device 512 in ultrasonic energy system 515 may send ultrasonic energy 516 in portion 518 of sheet metal material 500 around stylus 508.

Of course, in other advantageous embodiments, platform 506 may move in an X and Y direction with frame 502 moving along Z-axis 510. The types of movements of the different components may vary, depending on the particular implementation. In this example, frame 502 may be stationary, while platform 506 may move along Z-axis 510. Stylus 508 also may move along Z-axis 510, as well as along X and Y axes in these examples.

In FIG. 6, platform 506 may have moved along Z-axis 510 in an upward motion towards stylus 508 as indicated by arrow 600. In FIG. 7, platform 506 may have moved another distance upward in the direction of arrow 600, while stylus 508 may have moved another distance downward in the direction of arrow 700, as well as along the X and Y axes to form a shape for sheet metal material 500.

The illustrations of incremental sheet forming machine 503 in FIGS. 5, 6, and 7 are for purposes of illustrating one manner in which incremental sheet forming machine 302 in FIG. 3 can be implemented. Other advantageous embodiments may be implemented differently.

For example, without limitation, other incremental sheet forming machines may have other numbers of ultrasonic energy devices or other mechanisms to move the ultrasonic energy devices. The ultrasonic energy device may be moved below sheet metal material 500 in some advantageous embodiments. In still other advantageous embodiments, ultrasonic energy device 512 may be moved separately from stylus 508 such as, for example, without limitation, a robotic arm.

Figure 8:
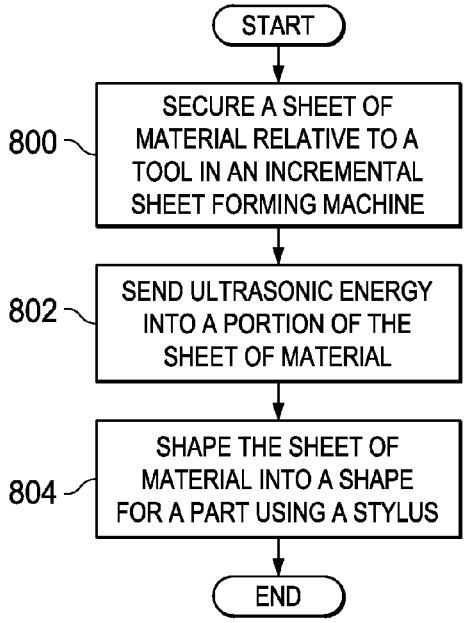
FIG. 8 is an illustration of a flowchart of a process for processing a sheet of material in accordance with an advantageous embodiment.

With reference next to FIG. 8, an illustration of a flowchart of a process for processing a sheet of material is depicted in accordance with an advantageous embodiment. The process illustrated in FIG. 8 may be implemented using manufacturing environment 300 in FIG. 3. More specifically, the process may be implemented using incremental sheet forming machine 302 in FIG. 3 to form sheet of material 304 into shape 306 for part 308.

The process may begin by securing sheet of material 304 relative to tool 324 in incremental sheet forming machine 302 (operation 800). In these examples, sheet of material 304 may be secured relative to tool 324 in a number of different ways. For example, sheet of material 304 may be secured above tool 324, below tool 324, or beside tool 324, depending on the particular implementation. Tool 324 may have a rough shape used to shape sheet of material 304 into shape 306.

The process may then send ultrasonic energy 346 into portion 350 of sheet of material 304 (operation 802). Further, sheet of material 304 may then be shaped into shape 306 for part 308 using stylus 322 (operation 804), with the process terminating thereafter. Operation 802 may send ultrasonic energy 346 directly into portion 350 and/or through stylus 322.

Ultrasonic energy 346 may be sent prior to stylus 322 impinging sheet of material 304 at location 352 in portion 350 and/or directly through stylus 322 as stylus 322 impinges sheet of material 304 at location 352 in portion 350. Additionally, ultrasonic energy 346 may continue to be sent into location 352, while stylus 322 impinges on sheet of material 304 at location 352. In other words, operation 802 and operation 804 may be performed simultaneously or substantially at the same time.

Figure 9:
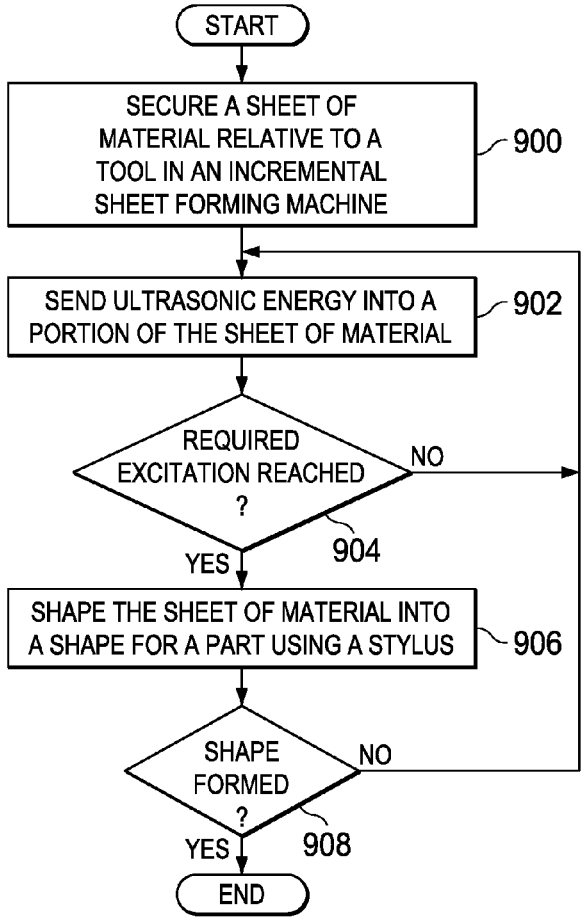
FIG. 9 is an illustration of a flowchart of a process for incremental processing of a sheet of material in accordance with an advantageous embodiment.

With reference now to FIG. 9, an illustration of a flowchart of a process for incrementally processing a sheet of material is depicted in accordance with an advantageous embodiment. The process illustrated in FIG. 9 may be implemented using manufacturing environment 300 in FIG. 3. In these illustrative examples, the process illustrated in FIG. 9 may be a more detailed description of the process illustrated in FIG. 8.

The process may begin by securing sheet of material 304 relative to tool 324 in incremental sheet forming machine 302 (operation 900). The process may then send ultrasonic energy 346 into portion 350 of sheet of material 304 (operation 902). Ultrasonic energy 346 may be sent into portion 350 to excite portion 350 of sheet of material 304. Thereafter, the process may determine whether the required excitation 361 has been reached (operation 904). This determination may be made by using vibration sensor 360 to measure excitation 361 of sheet of material 304. If the required excitation has not been reached, the process may then return to operation 902 as described above.

Otherwise, if the required excitation has been reached, the process may then shape sheet of material 304 into shape 306 for part 308 using stylus 322 (operation 906). Thereafter, the process may determine whether shape 306 has been formed (operation 908). If shape 306 has not been formed, the process may return to operation 902 as described above. Otherwise, the process may then terminate.

The flowcharts and block diagrams in the different depicted embodiments illustrate the architecture, functionality, and operation of some possible implementations of apparatus and methods in different advantageous embodiments. In this regard, each block in the flowcharts or block diagrams may represent a module, segment, function, and/or a portion of an operation or step. In some alternative implementations, the function or functions noted in the blocks may occur out of the order noted in the figures. For example, in some cases, two blocks shown in succession may be executed substantially concurrently, or the blocks may sometimes be executed in the reverse order, depending upon the functionality involved.

Thus, the different advantageous embodiments provide a method and apparatus for processing a sheet of material. In one or more of the different advantageous embodiments, an apparatus may comprise a platform, a stylus, and an ultrasonic energy system. The platform is capable of holding a sheet of material. The stylus is capable of impinging the sheet of material to incrementally form a shape for the part. The ultrasonic energy system is capable of sending ultrasonic energy into a portion of the sheet of material in a location on the sheet of material. The stylus may impinge the sheet of material at the location. The ultrasonic energy may be sent directly into the sheet of material and/or through the stylus when and/or before the stylus impinges the location. The ultrasonic energy may be sent prior to the stylus impinging the location, depending on the particular implementation.

With these and other advantageous embodiments, incremental sheet forming of materials, such as sheet metal, may be performed on materials that may be normally considered too hard to perform sheet metal forming processes with commercially available incremental sheet forming machines. The different advantageous embodiments provide a capability to create parts using an incremental sheet forming machine by applying ultrasonic energy to the sheet metal in a manner that changes the characteristics of the sheet metal. The ultrasonic energy applied to change the characteristics may enable easier shaping of the sheet metal material.

The description of the different advantageous embodiments has been presented for purposes of illustration and description, and it is not intended to be exhaustive or limited to the embodiments in the form disclosed. Many modifications and variations will be apparent to those of ordinary skill in the art.

Although the different advantageous embodiments have been described with respect to parts for aircraft, other advantageous embodiments may be applied to parts for other types of platforms. For example, without limitation, other advantageous embodiments may be applied to a mobile platform or a stationary platform.

Further, different advantageous embodiments may provide different advantages as compared to other advantageous embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. An apparatus comprising:

a platform capable of holding a sheet of material;

a stylus capable of impinging the sheet of material to incrementally form a shape for a part;

an ultrasonic energy generation system capable of sending ultrasonic energy into at least a portion of the sheet of material in a location on the sheet of material where the stylus impinges the sheet of material;

a control system controlling generation of the ultrasonic energy by the ultrasonic energy generation system; and a number of sensors capable of generating information, wherein the control system is capable of controlling the ultrasonic energy generated by the ultrasonic energy generation system using the information generated by the number of sensors.

2. The apparatus of claim 1, wherein the portion of the sheet of material is an area around the stylus upon impingement of the location on the sheet of material by stylus.

3. The apparatus of claim 1, wherein the ultrasonic energy generation system is selected from at least one of a transducer and an ultrasonic actuator.

4. The apparatus of claim 3, wherein the ultrasonic energy generation system comprises a number of ultrasonic energy devices coupled to at least one of the stylus and the portion of the sheet of material.

5. The apparatus of claim 1, wherein the ultrasonic energy generation system is capable of causing vibrations in the sheet of material that causes at least one of a temporary reduction in yield strength, a temporary increase in elongation, a temporary increase in ductility, and a temporary reduction in modulus for the sheet of material.

6. The apparatus of claim 1, wherein the number of sensors is selected from at least one of a temperature sensor, a vibration sensor, a microphone, and a load sensor.

7. The apparatus of claim 1 further comprising:

a motion control system capable of controlling movement of the stylus.

8. The apparatus of claim 1, wherein the sheet of material is comprised of a material selected from one of aluminum, titanium, steel, a steel alloy, a nickel alloy, a titanium alloy, and an aluminum alloy.

9. The apparatus of claim 1, wherein the shape for the part is for an object selected from one of a mobile platform and a stationary platform.

10. The apparatus of claim 1, wherein the control system controlling generation of the ultrasonic energy by the ultrasonic energy generation system further controls frequency of the energy.

11. The apparatus of claim 10, wherein the control system provides a frequency of ultrasonic energy greater than around 20 kilohertz.

12. The apparatus of claim 1 further comprising a thermal control system controlling ultrasonic energy generated by the ultrasonic energy generation system using information generated by the number of sensors.

13. An incremental sheet metal forming machine comprising:

a platform capable of holding a sheet of material;

a stylus capable of impinging the sheet of material to incrementally form a shape for a part;

a motion control system capable of controlling movement of the stylus;

an ultrasonic energy generation system comprising a number of ultrasonic energy generation devices, wherein the ultrasonic energy generation system is capable of causing vibrations in at least a portion of the sheet of material in a location on the sheet of material in an area around the stylus prior to the stylus impinging the location to cause at least one of a temporary reduction in yield strength, a temporary increase in elongation, a temporary increase in ductility, and a temporary reduction in a modulus for the sheet of material; wherein the ultrasonic energy generation system is coupled to the stylus, and wherein the number of ultrasonic energy generation devices is selected from at least one of a transducer and an ultrasonic actuator;

a number of sensors capable of generating information, wherein the number of sensors is selected from at least one of a temperature sensor, a vibration sensor, a microphone, and a load sensor, wherein a thermal control system is capable of controlling ultrasonic energy generated by the ultrasonic energy generation system using the information generated by the number of sensors; and a control system capable of controlling the ultrasonic energy generated by the ultrasonic energy generation system using the information from the number of sensors.

14. A method for processing a sheet of material, the method comprising:

securing the sheet of material relative to a tool in an incremental sheet metal forming machine;

incrementally shaping the sheet of material into a shape of a part using a stylus; and sending ultrasonic energy into at least a portion of the sheet of material in a location at which the stylus is to impinge prior to the stylus impinging the sheet of material at the location to cause vibrations in the portion of the sheet of material that causes at least one of a temporary reduction in yield strength, a temporary increase in elongation, a temporary increase in ductility, and a temporary reduction in a modulus for the sheet of material.

15. The method of claim 14, wherein the portion of the sheet of material is an area around the stylus.

16. The method of claim 14, wherein the sending step is performed by a number of ultrasonic energy generation devices selected from at least one of a transducer coupled to the stylus, a transducer coupled to the portion of the sheet of material, a transducer coupled to the stylus, and a transducer coupled to the portion of the sheet of material.

17. The method of claim 14, wherein the sheet of material is a sheet of metal material.

18. The method of claim 14, wherein a frequency of ultrasonic energy is greater than around 20 kilohertz.

19. A method for processing a sheet of metal material into a shape for an aircraft part, the method comprising:

securing the sheet of metal material relative to a tool in an incremental sheet metal forming machine;

incrementally shaping the sheet of metal material into the shape of the aircraft part using a stylus; and sending ultrasonic energy into at least a portion of the sheet of metal material in a location at which the stylus is to impinge the sheet of metal material to cause vibrations in the portion of the sheet of metal material that causes at least one of a temporary reduction in yield strength, a temporary increase in elongation, a temporary increase in ductility, and a temporary reduction in a modulus for the sheet of metal material.

* * * * *